United States Patent [19]

MacPherson et al.

[11] Patent Number: 4,516,281

[45] Date of Patent: May 14, 1985

[54] SEWAGE TREATMENT DEVICE

[75] Inventors: David B. MacPherson, Brunswick; Jay E. Paris, West Bass; Robert W. Foley, Cumberland Foreside; Martin W. Greinier, Westbrook; David N. Pulsifer, Brunswick, all of Me.

[73] Assignee: The Eastern Company, Naugatuck, Conn.

[21] Appl. No.: 495,150

[22] PCT Filed: Oct. 9, 1981

[86] PCT No.: PCT/US81/01363

§ 371 Date: May 11, 1983

§ 102(e) Date: May 11, 1983

[87] PCT Pub. No.: WO83/01267

PCT Pub. Date: Apr. 14, 1983

[51] Int. Cl.[3] ..... E03D 9/10

[52] U.S. Cl. ..... 4/319; 4/320; 4/321; 4/323; 4/222; 210/104; 210/173

[58] Field of Search ..... 4/321, 320, 322, 224, 4/323, 431, 319, 222, 227, 300, 312, 314, 317, 318; 210/139, 173, 797, 104; 241/46 R

[56] References Cited

U.S. PATENT DOCUMENTS

| | | | |
|---|---|---|---|
| 2,718,012 | 9/1955 | Howe | 4/319 |
| 2,951,251 | 9/1960 | Belden | 4/321 |
| 3,094,707 | 6/1963 | Fleming | 4/321 |
| 3,195,149 | 7/1965 | Carlson | 4/320 |
| 3,228,036 | 1/1966 | Zaske et al. | 4/320 |
| 3,275,550 | 9/1966 | Daubenspeck | 4/319 X |
| 3,323,650 | 6/1967 | Kilbane, Jr. | 4/431 X |
| 3,563,384 | 2/1971 | Delaney et al. | 4/323 |
| 3,713,177 | 1/1973 | Tufts et al. | 4/320 |
| 3,727,241 | 4/1973 | Drouhard et al. | 4/321 X |
| 3,840,914 | 10/1974 | Tufts et al. | 4/224 |
| 3,846,847 | 11/1974 | Tufts et al. | 4/320 |
| 4,054,519 | 10/1977 | Tufts | 210/104 |
| 4,131,959 | 1/1979 | Abertassi et al. | 4/320 |
| 4,170,798 | 10/1979 | Krumdieck | 4/319 |
| 4,214,324 | 7/1980 | Kemper et al. | 4/321 |
| 4,246,665 | 1/1981 | Albertassi et al. | 4/320 |
| 4,319,366 | 3/1982 | Baker, Jr. et al. | 4/431 |

FOREIGN PATENT DOCUMENTS

| | | | |
|---|---|---|---|
| 1040806 | 10/1978 | Canada | 4/320 |
| 1098883 | 1/1968 | United Kingdom | 210/173 |

*Primary Examiner*—Henry K. Artis

*Attorney, Agent, or Firm*—Frijouf, Rust & Pyle

[57] ABSTRACT

A sewage treatment device [10] is disclosed for use with a toilet [12] having a water flush input [16] and a sewage output [22]. The invention incorporates a treatment tank [56] connected for receiving the sewage from the sewage output [22] of the toilet. A disinfectant holding tank [58] is included for holding a disinfectant such as conventional household bleach. A mascerator blade [74] is disposed within the treatment tank [56] for mascerating the sewage to reduce the size of the particulate matter within the treatment tank [56]. An electric motor rotates the mascerator blade [74] and simultaneously pumps a disinfectant from the disinfectant holding tank [58] to the treatment tank [56]. A discharge pump [86] discharges the treated sewage from the treatment tank [56]. A control senses the level of the sewage in the sewage treatment tank and controls the sequence of operation of the mascerator blade [74] and the discharge pump [86]. The sewage treatment device [10] is suitable for use with a marine head as well as toilets located in mobile vehicles and permanent installations.

14 Claims, 21 Drawing Figures

SEWAGE TREATMENT DEVICE

DESCRIPTION

1. Technical Field

This invention relates to the treatment of sewage and more particularly to a system for the treatment of human waste from a toilet.

2. Background Art

Traditionally, marine heads on smaller boats and yachts had three distinct systems for eliminating human waste on board ships. The first type of prior art marine head incorporated an input sea cock connected by a conduit to a pump for water input to the marine head. The sewage from the head was then pumped through an output conduit to an output sea cock. The second type of prior art marine head incorporated a removable holding tank to receive the sewage. The holding tank was removed from the boat for emptying when the boat was in port. This second type of marine head is commonly referred to as a "portable marine head" which was also compatible for use in land vehicles such as campers, recreational vehicles, motor homes and the like. The third type of prior art marine head included an input and output sea cock and associated pump with a permanently mounted holding tank. The system utilized a Y-valve for directing the sewage to either a permanently mounted holding tank when the vessel was in port or within protected water or for directing the sewage for direct overboard discharge when the vessel was at sea.

Public Law 40 C.F.R. 140.3 regulates the discharge of sewage from marine vessels in fresh water lakes and reservoirs as well as rivers, coastal waters, great lakes and intercoastal waterways. The United States Coast Guard certifies marine sanitation devices for use in the aformentioned waters in addition to enforcing the discharge of sewage from marine heads. Accordingly, some in the prior art have attempted to simultaneously treat and discharge sewage from a toilet in a maring vessle. However, many of these prior art devices which will be described hereinafter do not meet the aformentioned federal standards for the discharge of treated sewage in the protected waters.

U.S. Pat. No. 3,195,149 to Carlson shows an apparatus for chlorination of toilet sewage for connection to a conventional marine head.

U.S. Pat. No. 3,323,650 to Kilbane shows a marine chlorinator utilizing a motor for pumping, mascerating and discharging sewage and for pumping a metered amount of treatment mateial into the waste product.

U.S. Pat. No. 3,480,543 to Hildebrand shows a process and apparatus for disinfecting sewage using a hydraulic circuit.

U.S. Pat. No. 3,536,196 to Zeff et al. shows a system for treating waste from a toilet incorporating a temporary holding tank for recirculating flushing liquid to a toilet.

U.S. Pat. No. 3,669,592 to Minchak utilizes a marine toilet having a mascerator blade, a metering pump and a discharge pump integrally incorporated into a marine head.

U.S. Pat. No. 3,713,177 to Tufts et al. illustrates a novel marine toilet incorporating a mascerator and a temporary holding tank for treating sewage from a marine head.

U.S. Pat. No. 3,755,827 to Riedel illustrates a combined toilet and sewage treatment apparatus having a mascerator blade and a first and a second chamber.

U.S. Pat. No. 3,840,914 to Tufts shows a combination marine toilet provided with a bowl, trap and discharge line with means for automatically inserting treatment tablets into the sewage material.

U.S. Pat. No. 3,846,847 to Tufts illustrates a further improvement of a marine toilet utilizing a mascerator device and an improved valving system.

U.S. Pat. No. 4,054,519 to Tufts discloses a marine toilet having an improved mascerator chamber and associated blade for reducing the particle size of the sewage.

U.S. Pat. No. 4,131,959 to Albertassi et al. illustrates an integral non-polluting toilet system incorporating a mascerator blade and associated treatment devices.

U.S. Pat. No. 4,248,665 also to Albertassi is a further improvement of the non-polluting toilet system suitable for adaptation to marine heads.

Although the aformentioned patents have solved many needs in the prior art, there is a need for further improvement in the sewage treatment art in relation to the use on marine vessels. Specifically, most marine vessels already have a conventional toilet and it would be desirable to provide a treatment system for use with a conventional marine head for discharging treated sewage resuling in a lower cost to the consumer rather than replacing the entire toilet system.

Therefore it is an object of this invention to provide an apparatus which overcomes the aformentioned inadequacies of the prior art devices and provides an improvement which is a significant contribution to the advance of the sewage treatment art.

Another object of this invention is to provide a sewage treatment device for use with a toilet wherein the sewage treatment system may be connected to a conventional marine toilet and used when the vessel is within controlled waters and may be bypassed through a novel valve assembly when the vessel is at sea.

Another object of this invention is to provide a sewage treatment device for use with a toilet which is compact in size and capable of being installed in small boats and yachts.

Another object of this invention is to provide a sewage treatment device for use with a toilet wherein the sewage treatment device may be bypassed in the remote event of malfunction of the sewage treatment device.

Another object of this invention is to provide a sewage treatment device for use with a toilet utilizing a readily obtainable disinfectant which may be purchased at virtually any port within the world.

Another object of this invention is to provide a sewage treatment device for use with a toilet which is specifically designed for use in a hostile marine environment.

Another object of this invention is to provide a sewage treatment device for use with a conventional marine head wherein the treatment device may be readily disconnected enabling the marine head to be operated in a conventional fashion in the unlikely event that service is required on the sewage treatment system.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

DISCLOSURE OF THE INVENTION

The invention is defined by the appended claims with a specific embodiment shown in the attached drawings. For the purpose of summarizing the invention, the invention may be incorporated into a sewage treatment device for use with a toilet having a water flush input and a sewage output. The device comprises a treatment tank connected to the sewage output from the toilet. A disinfectant holding tank is provided in the device for holding a conventional disinfectant such as household bleach or the like. A mascerator blade is disposed in the treatment tank for reducing the particle size of the sewage from the marine head. A disinfectant pump is provided for pumping the disinfectant from the disinfectant holding tank to the treatment tank. Motive means rotates the mascerator blade within the treatment tank and simultaneously drives the disinfectant pump for mascerating and treating the sewage within the treatment tank. A discharge pump discharges the treated sewage from the treatment tank for overboard discharge.

In a more specific embodiment of the invention, the treatment tank and disinfectant tank are preferably formed of a unitary plastic material. A valve assembly is provided for directing the sewage output from the toilet to the treatment tank when the valve is in a first position and for directing the sewage output from the toilet to bypass the treatment tank for direct discharge when the valve is in a second position. The novel valve assembly is provided with a plastic housing and O-ring seal means for sealing the rotatable valve member within a valve chamber.

Preferably, a motor is utilized for rotating the mascerator blade and the disinfectant pump to simultaneously mascerate and treat the sewage. The mascerator blade is connected to one end of the motor shaft whereas the disinfectant pump is connected to the other end of the motor shaft. The disinfectant pump preferably comprises a substantially cylindrical chamber with a flexible conduit disposed therein. An eccentric means coacts with the periphery of the substantially cylindrical container to depress the flexible conduit upon movement of the eccentric means to pump the disinfectant thereby.

The discharge pump of the apparatus preferably includes a flexible rotor disposed in an eccentric chamber with a novel input and an output port connected to the eccentric pumping chamber enabling large undissolved particulate matter such as fruit seeds and the like to be readily discharged through the discharge pump.

The invention also comprises a series of one-way valves to prevent overfilling of the treatment tank in the event of improper operation of the device as well as a novel control circuit for automatically indicating the need for treatment of the sewage within the holding tank.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following drawings in which.

Similar reference characters refer to similar parts throughout the several views of the drawings.

BEST MODE FOR CARRYING OUT THE INVENTION

Figure 1:
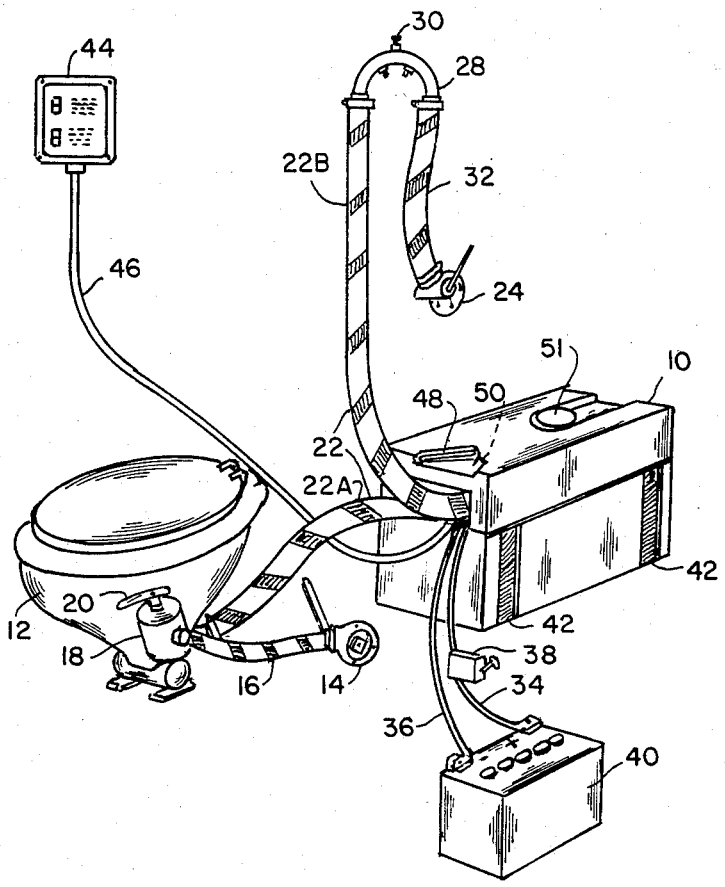
FIG. 1 is an elevational view of the sewage treatment device installed with a conventional marine head.

FIG. 1 illustrates a sewage treatment device 10 for use with a toilet 12 shown as a conventional marine head. The marine head 12 is installed on a vessel (not shown) with an input sea cock 14 being connected by a conduit 16 to a pump 18 installed on the marine head 12. The pump has a pump handle 20 for pumping input water from sea cock 14 to discharge toilet sewage through output conduit 22 connected to an output sea cock 24. The output conduit 22 preferably includes a riser 22B connected to a vented loop 28 having a vent 30 with a conduit 32 interconnecting the loop 28 to output sea cock 24. The riser conduit, loop 28 and conduit 32 function as an anti-siphon device as should be well known by those skilled in the art.

In this embodiment, the sewage treatment device 10 is interposed between conduits 22A and 22B and is further connected by electrical connector 34 and 36 through a master switch 38 to the electrical supply of the vessel shown as a battery 40. It should be appreciated by those skilled in the art that the installation of the sewage treatment device 10 merely requires the severing of tube 22 into portions 22A and 22B in addition to the electrical connections 34 and 36 through switch 38.

The sewage treatment device 10 may be secured to the vessel by straps (not shown) extending through slots 42. Additionally, a control panel 44 is mounted to a bulkhead (not shown) and is connected by electrical connector 46 to the sewage treatment device 10.

The sewage treatment device 10 includes a novel valve assembly which will be explained hereinafter controlled by handle 48 whereby sewage may be pumped directly from toilet 12 through conduit 22A and 22B to output sea cock 24 when the valve 50 is in a first position. The device 10 may treat the sewage and discharge through conduit 22B when valve 50 is in a second position (not shown). Disinfectant for the sewage may be conveniently filled through a filler tap 51 disposed on the upper portion of the sewage treatment device 10.

Figure 2:
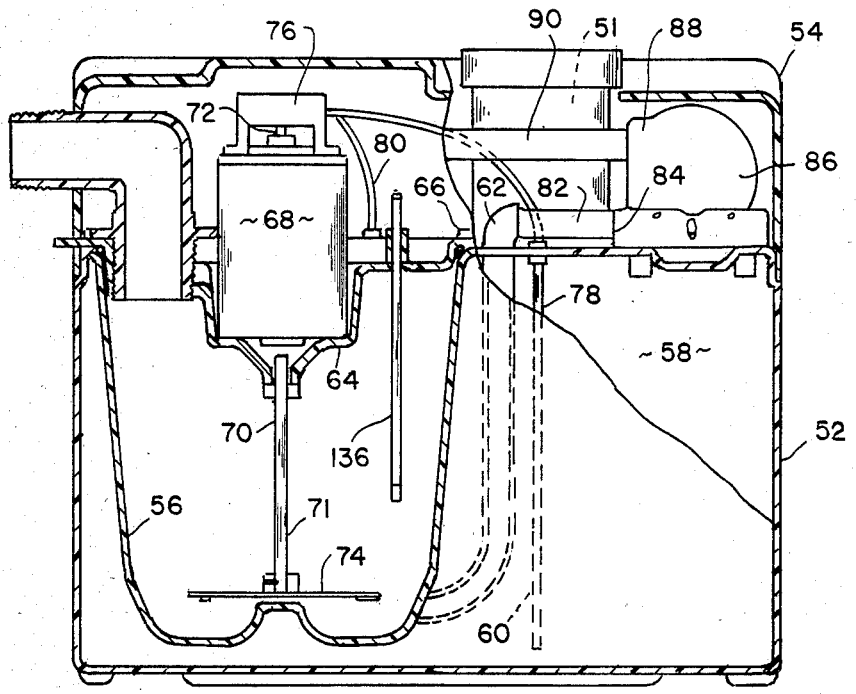
FIG. 2 is a side sectional view of the sewage treatment device.
Figure 3:
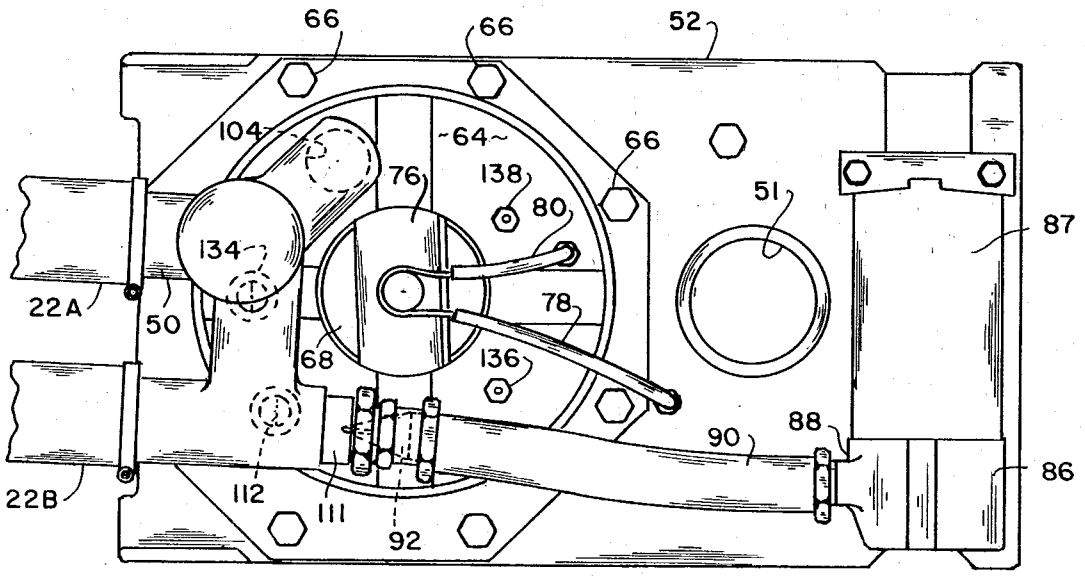
FIG. 3 is a top view of the sewage treatment device.

FIGS. 2 and 3 show various views of the sewage treatment device 10 comprising a body member 52 and a cover 54 both preferably made of a plastic material. A treatment tank 56 is integrally molded within the body member 52 with the remaining volume 58 functioning as a disinfectant holding tank. A discharge conduit 60 is interconnected between the treatment tank 56 and an elbow 62 for removing the sewage from the treatment tank subsequent to treatment as will be described hereinafter.

A support member 64 is affixed to the upper surface of the body 52 by preferably nylon bolts 66 for positioning a motor 68 to be aligned coaxial with the treatment tank 56. A motor shaft 70 has a first end 71 extending downwardly into the treatment tank 56 whereas a second end 72 extends from the opposite side of the motor 68. A mascerator blade 74 is secured to the first end 71 of the motor shaft whereas the second end 72 is positioned for driving a disinfectant pump 76 for pumping disinfectant from the disinfectant holding tank 58 by conduit 78 to be deposited within the treatment tank 56 through conduit 80.

The elbow 62 is connected by a discharge conduit 82 to an input 84 of a discharge pump 86 powered by a motor 87 with the output 88 of the discharge pump 86 being connected by a discharge conduit 90 to the valve 50. A one-way valve commonly referred to as a sphincter valve 92 enables fluid flow only in a direction from right to left in FIG. 3.

Figure 4:
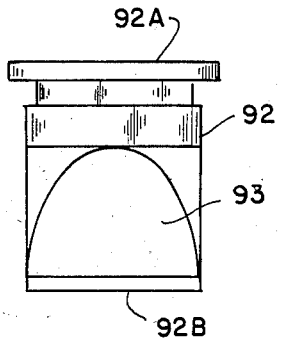
FIG. 4 is an elevational view of a valve for use in the sewage treatment device.
Figure 5:
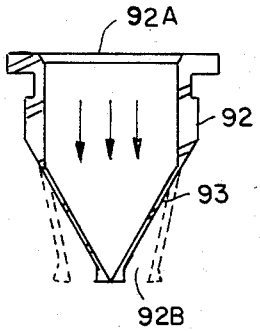
FIG. 5 is a sectional view along line 5—5 in FIG. 4.

FIGS. 4 and 5 illustrate the sphincter valve 92 having an input 92A and flexible sidewalls 93 creating an output 92B upon flexing into the open position as shown in phantom in FIG. 5. Fluid is only passed by the valve 92 in the direction shown by the arrows.

Figure 6:
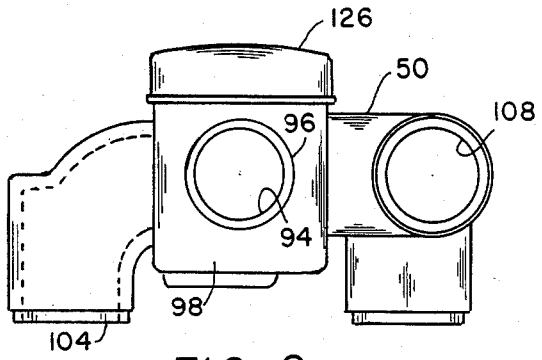
FIG. 6 is a front view of a novel valve assembly included within the sewage treatment device.
Figure 7:
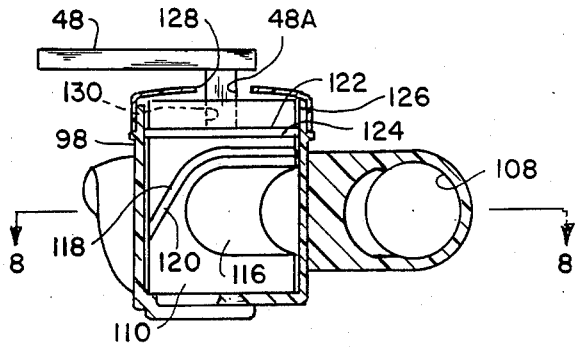
FIG. 7 is a sectional view of the valve of FIG. 6.
Figure 8:
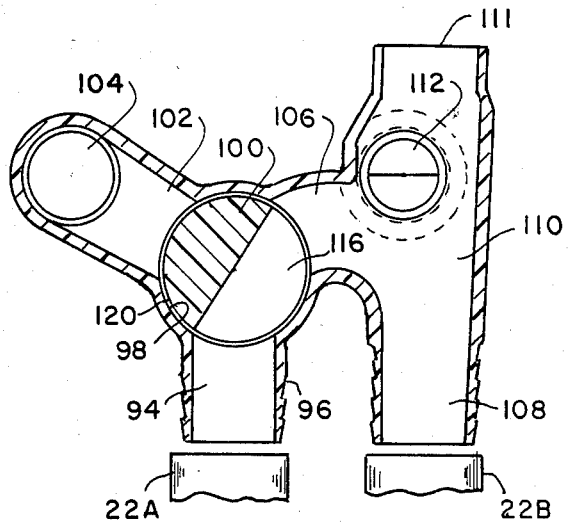
FIG. 8 is a sectional view along line 8—8 in FIG. 7.

The valve assembly 50, is shown more fully in FIGS. 6–8 and comprises an input 94 having an outer serrated surface 96 for receiving conduit 22A which may be secured by a conventional hose clamp. The input 94 leads into a substantially cylindrical valve chamber 98 with a rotatable valve member 100 disposed therein. The valve member 100 is rotated by handle 48 as also shown in FIG. 1. A passage 102 terminates in a sewage output 104 which is connected to the sewage treatment tank 56. A second passage 106 leads to another output 108 for connection to conduit 22B. A fluid passage 110 is also connected to a discharge input 111 adjacent the one-way valve 92 as shown in FIG. 3. Another one-way valve 112 which is also preferably a sphincter valve, connects the sewage treatment chamber 56 to passage 110 to allow fluid flow only from treatment chamber 56 into passage 110.

The rotatable valve member 100 is shown as a substantially cylindrical drum having a semi-cylindrical slot 116 with a groove 118 receiving an O-ring 120 for sealing the sewage flow from the upper portion of the valve assembly. The O-ring 120 extends about the entire periphery of the cylindrical valve member 100 as best shown in FIG. 7. A second substantially annular groove 122 receives a second sealing O-ring 124 to insure proper seal of the value. A valve cap 126 having a central aperture 128 is affixed to the valve chamber 98 by conventional screw threads with aperture 128 enabling insertion of a keyed leg 48A from handle 48 to engage in a keyed slot 130 to rotate the valve member 100 within the valve chamber 98. The valve assembly is preferably made of a one-piece plastic structure with the separate plastic rotatable member 100 disposed therein enabling the sewage treatment device 10 to be operated within a hostile marine environment.

An additional one-way valve 134, shown in phantom in FIG. 3, interconnects the outer ambient with the interior of the treatment chamber 56 to enable fluid flow only from the ambient into the treatment chamber 56.

Plural fluid level sensing elements 136 and 138 shown in FIGS. 2 and 3 extend downward into the treatment tank 56. These sensing elements are connected to the control 44 shown in FIG. 1 by connectors which are not shown in FIGS. 2 and 3 for the purposes of clarity.

Figure 9:
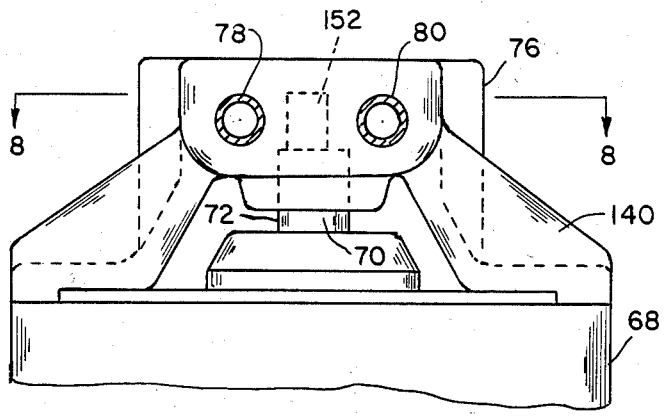
FIG. 9 is a front elevational view of a disinfectant pump.
Figure 10:
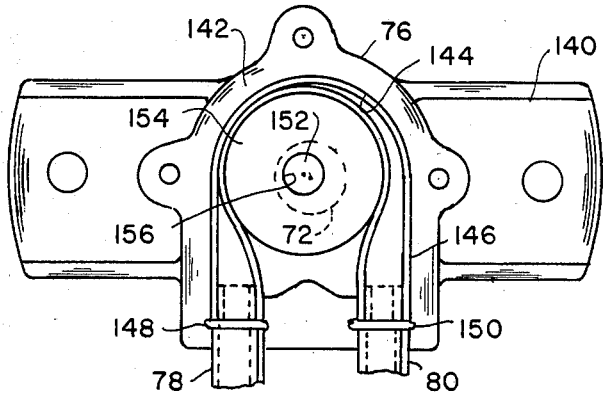
FIG. 10 is a sectional view along line 10—10 of FIG. 9.

FIGS. 9 and 10 illustrate front elevational and internal views of the disinfectant pump 76 which is secured to motor 68 by flanges 140 within an integral housing 142 having a partially circular pumping chamber 144. The disinfectant conduits 78 and 80 are connected by inserts 78A and 80A to a flexible conduit 146 positioned adjacent the sidewall of the pumping chamber 144. Fastening rings 148 and 150 engage in slots within the housing for securing the flexible conduit 146 as shown in FIG. 10. The second end 72 of motor shaft 70 is established with an eccentric projection 152 with a substantially circular impeller 154 having a central aperture 156 for rotatably receiving the eccentric projection 152. The impeller 154 is preferably made of a softer material such as brass whereas the motor shaft 70 is preferably made of a harder material such as stainless steel. Accordingly, upon rotation of motor 68 the eccentric projection 152 will result in eccentric motion of the circular impeller 154 causing a pumping of the fluid from conduit 78 to conduit 80. The differential in material hardness between the eccentric 152 and the impeller 154 insures that the impeller 154 will wear faster than the eccentric 152. The impeller is easily replaced for service after extended use of the sewage treatment system 10.

Figure 11:
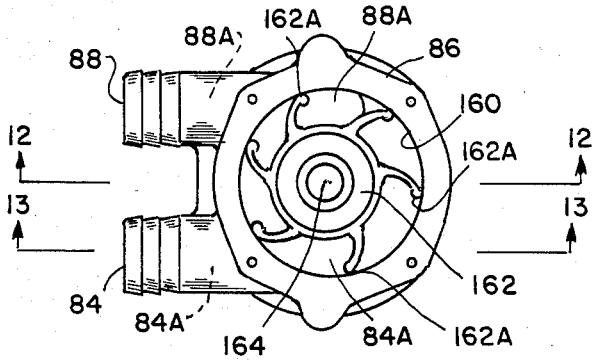
FIG. 11 is a plan view of a discharge pump with the top cover removed.
Figure 12:
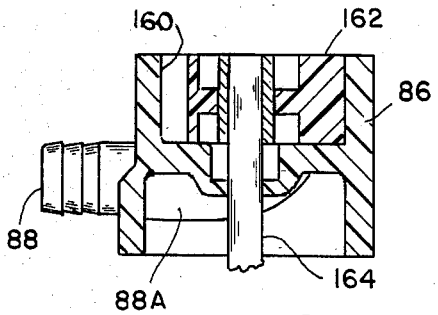
FIG. 12 is a sectional view along line 12—12 of FIG. 11.
Figure 13:
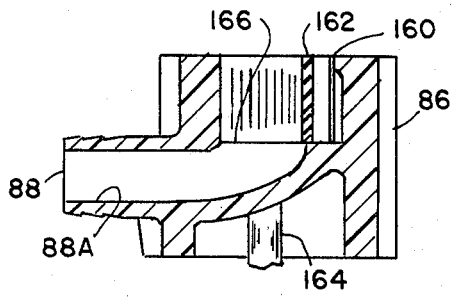
FIG. 13 is a sectional view along line 13—13 of FIG. 11.

FIGS. 11, 12 and 13 show various views of the discharge pump 86 comprising a one-piece plastic assembly having an eccentric chamber 160 with a rotor 162 comprising flexible vanes 162 secured to a shaft 164 of discharge motor 87 shown in FIG. 3. The rotor 162 is secured to the shaft 64 by conventional means which may include a key shaft or the like.

A distinction of the present discharge pump 86 over the prior art is in the contour of the input and output passageways 84A and 88A extending between the input 84 and output 88 and the pumping chamber 160, respectively. The input passage 88A as best shown in FIG. 13 introduces fluid in a bottom surface 166 of pumping chamber 160 in a region where the rotor vanes 162A are well extended as best shown in FIG. 11. This configuration, with the gradual contour of the passageway as shown in FIG. 13, enables undissolved sewage material such as fruit seeds and the like to be readily passed by the discharge pump without clogging. The introduction of the input and output passageways into the bottom surface of the pumping chamber in a position where the rotor arms 62A are separated provides a substantial improvement over the prior art impeller vane pumps.

Figure 14:
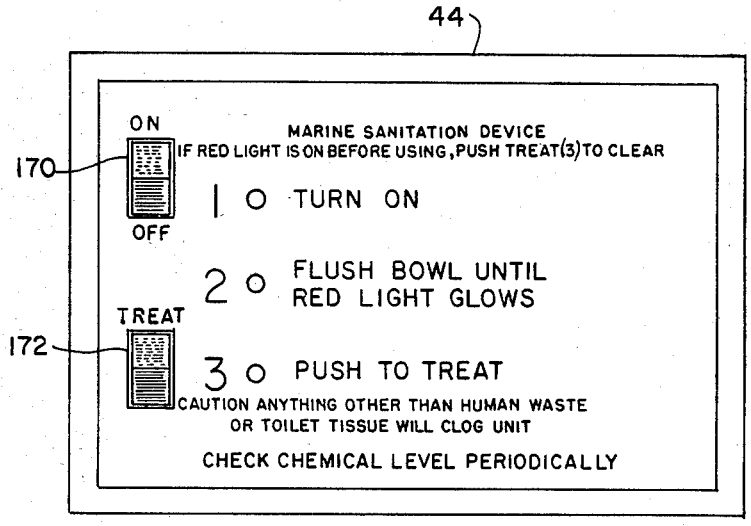
FIG. 14 is a front view of a control panel.
Figure 15:
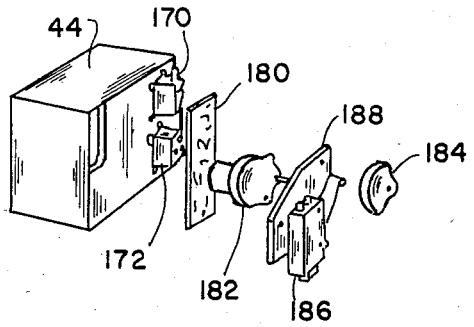
FIG. 15 is an exploded view of a control apparatus.

FIGS. 14 and 15 illustrate the control panel 44 comprising three indicator lights adjacent the numerals 1, 2 and 3 with two switches 170 and 172. Operating information for the unit is located upon the front panel of control 44.

The operation of the device should be apparent to those skilled in the art in view of the foregoing description of the internal mechanism of the apparatus 10 and the instructions upon the front panel of the control 44. The position of valve handle 48 determines the flow path of the sewage from the marine head 12. For offshore use, valve handle 48 is placed into the position as shown by the valve in FIG. 8 whereby pumping pump 18 of the marine head 12 will cause the sewage to enter input 94 and pass through groove 116 and passage 106 to flow through output 108 to conduit 22B. One-way valves 92 and 112 will prevent flow of sewage into the sewage treatment device 10. The apparatus may also be operated in this manner in the remote event of malfunction of the apparatus.

When the sewage treatment device 10 is used in protected waters, the valve handle 48 is placed into the other position enabling sewage to be pumped from conduit 22A through passage 102 and output 104 into treatment tank 56. When the switch 170 is in the ON position, the light adjacent the numeral 2 on control panel 44 in FIG. 14 will illuminate indicating a sufficient level of liquid is in the treatment chamber 56 as determined by fluid sensors 136 and 138. Thereafter, switch 172 is energized causing motor 68 to rotate for a predetermined period of time whereby the mascerator blade 74 pulverizes the sewage within the treatment tank 56. Concomitantly therewith metering pump 76 pumps a metered amount of disinfectant from holding tank 58 to the treatment tank 56 to treat the sewage within the sewage treatment tank. After the motor has operated for a predetermined period of time, motor 68 is terminated in operation and discharge motor 87 is energized for rotating pump 86 to discharge the treated sewage along conduit 90 to flow into input 111 of valve 50 to exit into conduit 22B. Sphincter valve 112 prevents flow of the treated sewage into the treatment tank 56. The time of rotation of motors 68 and 86 are controlled by a control circuit internal the control panel 44.

In the event the operator misuses the apparatus by continuously pumping sewage into the sewage treatment tank 56 without treatment, the untreated sewage will flow through one-way valve 112 through output 108 to conduit 22B for direct discharge through sea cock 24. Although this misuse of the apparatus is not recommended, the safety feature prevents damage to the treatment chamber 56 which may be caused by the hydrostatic pressure created by pump 18. One-way valve 134 shown in FIG. 3 enables air to enter the treatment chamber 56 upon discharge by discharge pump 86 and also enables any liquid which accumulates on the support surface 64 to enter the treatment tank 56.

The control circuit within the control box 44 may be a completely electronic unit, or in the alternative, comprise a rotatable cam as shown in FIGS. 15 and 16. The control comprises a circuit board 180 and a timing motor 182 driving a cam 184 placed adjacent a microswitch 186. The microswitch 186, motor 182 and cam 184 are mounted on a support board 188. The microswitch 186 is a three-position microswitch, for example a microswitch sold under the trademark "Cherry E-20".

FIGS. 16A–16F show the various positions of the treatment switch 172 and the microswitch 178 with the orientation of the cam 184 driven by timing motor 182. Cam follower 190 of microswitch 178 is shown in relation to the four regions 284A–184D of cam 184.

Figure 16A:
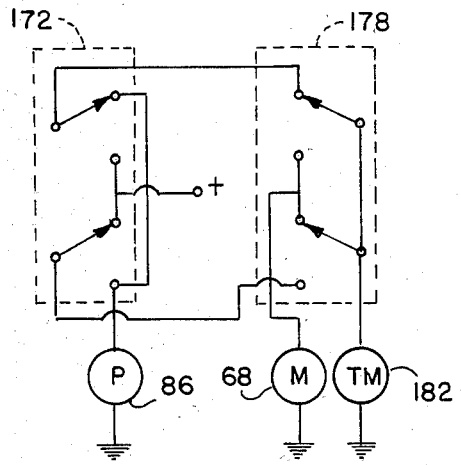
FIGS. 16A–F show various positions of a novel control circuit with an associated cam.
Figure 16A:
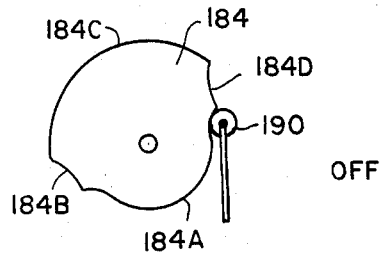

FIG. 16A shows the device 10 in the OFF condition with cam follower 190 in cam region 184A.

Figure 16B:
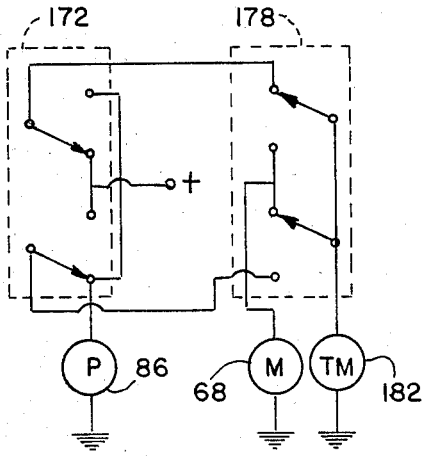
Figure 16B:
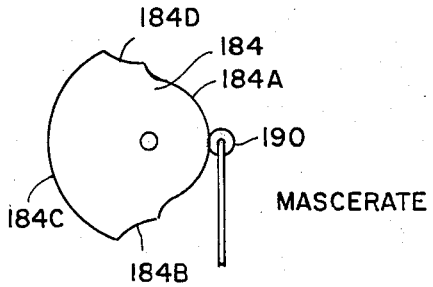

FIG. 16B illustrates the changing of switch 172 by the operator thereby energizing mascerator motor 68 and timing motor 182. The masceration continues during counterclockwise rotation of cam 184 until cam follower 190 engages cam region 184B to change the position of microswitch 178 as shown in FIG. 16C.

Figure 16C:
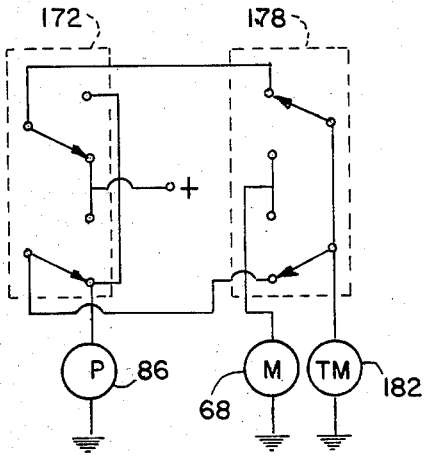
Figure 16C:
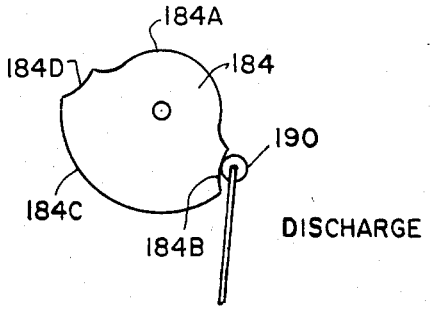

FIG. 16C shows the deactivation of mascerator motor 68 and the activation of discharge pump motor 87 with the associated discharge pump 86. The discharge pump 86 continues until cam follower 190 reaches the cam region 184C as shown in FIG. 16D.

Figure 16D:
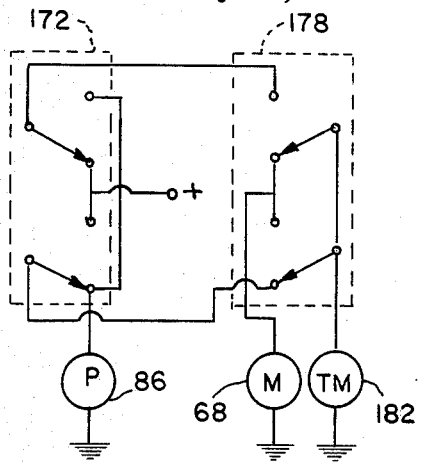
Figure 16D:
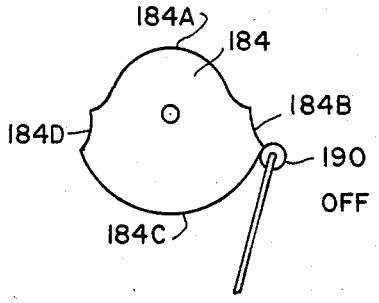

FIG. 16D illustrates the cam follower 190 in the initial cam region 184C and the associated effect on microswitch 178. In this position, the device 10 is again in the OFF condition.

Figure 16E:
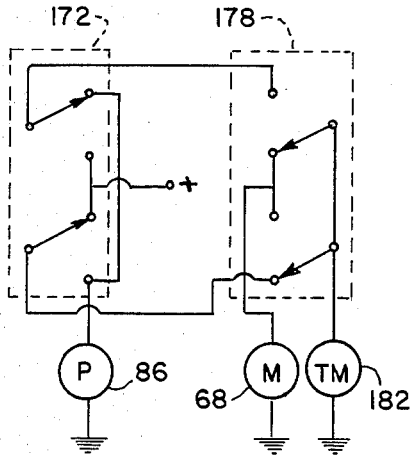
Figure 16E:
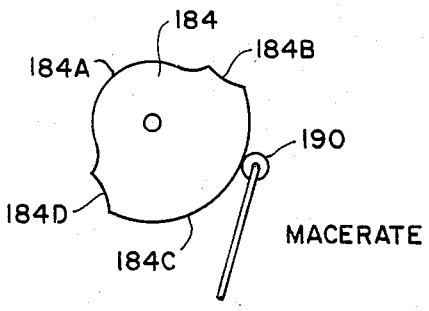

FIG. 16E illustrates the changing of switch 172 by the operator for the next use of the device 10 thereby energizing mascerator motor 68 and timing motor 182. The masceration continues during counterclockwise rotation of cam 184 until cam follower 190 engages cam region 184D to again change the position of microswitch 178 as shown in FIG. 16F.

Figure 16F:
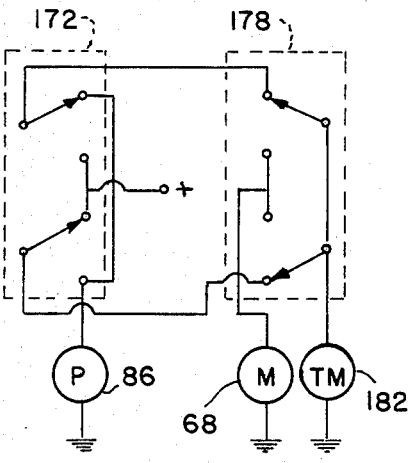
Figure 16F:
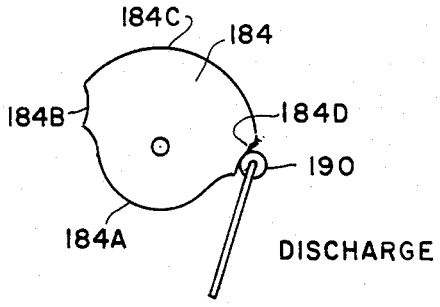

FIG. 16F shows the deactivation of mascerator motor 68 and the activation of discharge pump 86. The discharge pump 86 continues until cam follower 190 reaches cam region 184A as shown in FIG. 16A whereat the device is again placed in the OFF condition.

The use of a single microswitch 186 and a single cam 184 substantially simplifies the alignment and timing difficulties normally encountered with multiple cams and multiple microswitches. The simplified adjustment substantially reduces the cost of the sewage treatment device 10.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

Now that the invention has been described, I claim:

1. A sewage treatment device for use with a toilet having a water flush input and a sewage output to treat with a disinfectant, comprising in combination:

a treatment tank;

connecting means for connecting the sewage output from the toilet to said treatment tank enabling water entering the water flush input of the toilet to transfer the sewage from the sewage output of the toilet to said treatment tank;

a disinfectant holding tank for holding the disinfectant;

a macerator blade disposed in said treatment tank;

a rotatable disinfectant pump for pumping disinfectant from said disinfectant holding tank to said treatment tank;

a motor for rotating said macerator blade within said treatment tank and for simultaneously rotating said disinfectant pump for macerating the sewage in said treatment tank and for simultaneously treating the sewage within said treatment tank with the disinfectant;

said macerator blade reducing the particle size of the sewage in said treatment tank concomitantly with said disinfectant pump metering a preselected amount of disinfectant in the treatment tank upon each rotation of said disinfectant pump;

timing means connected to electric power to said motor for macerating the sewage for a preselected period of time and for introducing a specified volume of disinfectant into said treatment tank; and a discharge pump for discharging the treated sewage from said treatment tank.

2. A sanitation device as set forth in claim 1, wherein said motor for rotating said macerator blade and said discharge pump is disposed above said treatment tank.

3. A sewage treatment device as set forth in claim 1, wherein said connecting means includes a valve having a first and a second position;

said valve directing the sewage output from the toilet to said treatment tank when said valve is in said first position; and said valve directing the sewage output from the toilet to bypass said treatment tank when said valve is in said second position.

4. A sewage treatment device as set forth in claim 3, wherein said valve includes a valve chamber having an input and a first and second output;

a rotatable valve member having a valve aperture thereon;

said rotatable valve member being disposed in said valve chamber for connecting said input to said first output when said rotatable valve member is located in said first position and for connecting said input to said second output when said rotatable valve member is located in said second position; and O-ring means for sealing said valve aperture relative to said valve chamber.

5. A sewage treatment device as set forth in claim 1, wherein said motor for rotating said macerator blade and said disinfectant pump comprises an electric motor having a motor shaft extending from a first and a second side of said motor;

said macerator blade being connected to said motor shaft on said first side of said motor; and said disinfectant pump being connected to said motor shaft on said second side of said motor.

6. A sewage treatment device for use with a toilet having a water flush input and a sewage output, comprising in combination:

a treatment tank;

connecting means for connecting the sewage output from the toilet to said treatment tank;

a macerator blade disposed in said treatment tank;

a disinfectant pump for pumping disinfectant from said disinfectant holding tank to said treatment tank, said disinfectant pump comprising:

a pump housing having a substantially cylindrical chamber;

a flexible conduit disposed about at least a portion of the periphery of said substantially cylindrical chamber;

eccentric means located within said substantially cylindrical chamber for coaction with said periphery of said substantially cylindrical chamber to depress said flexible conduit upon movement of said eccentric means to pump the disinfectant thereby;

means for rotating said macerator blade within said treatment tank and for simultaneously driving said disinfectant pump for macerating and treating the sewage within said treatment tank; and a discharge pump for discharging the treated sewage from said treatment tank.

7. A sewage treatment device for use with a toilet having a water flush input and a sewage output, comprising in combination:

a treatment tank;

connecting means for connecting the sewage output from the toilet to said treatment tank;

a macerator blade disposed in said treatment tank;

a disinfectant pump for pumping disinfectant from said disinfectant holding tank to said treatment tank, said disinfectant pump comprising:

a pump housing having a substantially cylindrical chamber;

a flexible conduit disposed about at least a portion of the periphery of said substantially cylindrical chamber;

eccentric means located within said substantially cylindrical chamber for coaction with said periphery of said substantially cylindrical chamber to depress said flexible conduit upon movement of said eccentric means to pump the disinfectant thereby;

means for rotating said macerator blade within said treatment tank and for simultaneously driving said disinfectant pump for macerating and treating the sewage within said treatment tank, said means for rotating said disinfectant pump comprising:

a motor having a motor shaft;

said eccentric means including an eccentric projection disposed on said motor shaft;

a cylindrical rotor connected to said eccentric projection for causing eccentric rotation of said rotor within said substantially cylindrical chamber; and a discharge pump for discharging the treated sewage from said treatment tank.

8. A sewage treatment device for use with a toilet having a water flush input and a sewage output, comprising in combination:

a treatment tank;

connecting means for connecting the sewage output from the toilet to said treatment tank;

a macerator blade disposed in said treatment tank;

a disinfectant pump for pumping disinfectant from said disinfectant holding tank to said treatment tank, said disinfectant pump comprising:

a pump housing a substantially cylindrical chamber;

a flexible conduit disposed about at least a portion of the periphery of said substantially cylindrical chamber;

eccentric means located within said substantially cylindrical chamber for coaction with said periphery of said substantially cylindrical chamber to depress said flexible conduit upon movement of said eccentric means to pump the disinfectant thereby;

means for rotating said macerator blade within said treatment tank and for simultaneously driving said disinfectant pump for macerating and treating the sewage within said treatment tank, said means for rotating said disinfectant pump comprising:

a motor having a motor shaft;

said eccentric means including an eccentric projection disposed on said motor shaft, said eccentric projection being integral with said motor shaft;

a cylindrical rotor connected to said eccentric projection for causing eccentric rotation of said rotor within said substantially cylindrical chamber; and a discharge pump for discharging the treated sewage from said treatment tank.

9. A sewage treatment device for use with a toilet having a water flush input and a sewage output, comprising in combination:

a treatment tank;

connecting means for connecting the sewage output from the toilet to said treatment tank;

a macerator blade disposed in said treatment tank;

a disinfectant pump for pumping disinfectant from said disinfectant holding tank to said treatment tank, said disinfectant pump comprising:

a pump housing having a substantially cylindrical chamber;

a flexible conduit disposed about at least a portion of the periphery of said substantially cylindrical chamber;

eccentric means located within said substantially cylindrical chamber for coaction with said periphery of said substantially cylindrical chamber to depress said flexible conduit upon movement of said eccentric means to pump the disinfectant thereby;

means for rotating said macerator blade within said treatment tank and for simultaneously driving said disinfectant pump for macerating and treating the sewage within said treatment tank, said means for rotating said disinfectant pump comprising:

a motor having a motor shaft;

said eccentric means including an eccentric projection disposed on said motor shaft, said eccentric projection being integral with said motor shaft;

a cylindrical rotor connected to said eccentric projection for causing eccentric rotation of said rotor within said substantially cylindrical chamber;

said motor shaft comprising a harder material than said cylindrical rotor whereby pump wear occurs on said rotor, said cylindrical rotor being replaceable in the event of excessive wear of said cylindrical rotor; and a discharge pump for discharging the treated sewage from said treatment tank.

10. A sewage treatment device as set forth in claim 1, wherein said discharge pump comprises an eccentric pumping chamber having first and second parallel endwalls;

a flexible rotor having a plurality of extending rotor elements contacting the periphery of said eccentric pumping chamber;

an input port communicating with said eccentric pumping chamber to be substantially tangential relative to a portion of the outer periphery of said eccentric chamber enabling the treated sewage to enter said eccentric pumping chamber between said rotor element in a generally linear flow path; and an output port communicating with said eccentric pumping chamber to be substantially tangential relative to a second portion of the outer periphery of said eccentric pumping chamber enabling the treated sewage to exit from said eccentric pumping chamber in a generally linear flow path.

11. A sewage treatment device as set forth in claim 10, wherein said flow path of said input port is substantially parallel to the flow path of said output port.

12. A sewage treatment device as set forth in claim 11, wherein said input port and said output port are located in said eccentric pumping chamber enabling said treated sewage to curve approximately one hundred and eighty degrees about the periphery of said pumping chamber between said input and said output port.

13. A sewage treatment device as set forth in claim 12, wherein said input port and said output port enters through said first end wall of said eccentric pumping chamber; and said second end wall being removable for cleaning said flexible rotor.

14. A sewage treatment device as set forth in claim 1, including a cam driven by a timing device;

first switch means reponsive to operator control;

second switch means responsive to the position of said cam; and means connecting said first and second switch means for controlling said rotating means and said discharge pump in accordance with said timing motor.

* * * * *

UNITED STATES PATENT AND TRADEMARK OFFICE

CERTIFICATE OF CORRECTION

PATENT NO. : 4,516,281

DATED : May 14, 1985

INVENTOR(S) : MacPherson, David B.

It is certified that error appears in the above-identified patent and that said Letters Patent are hereby corrected as shown below:

Column 1, line 41, delete "maring" and insert --marine--.
Column 1, line 42, delete "vessle" and insert --vessel--.

In claim 8, column 10, line 63, after "housing" insert --having--.

Signed and Sealed this

*Fifteenth* Day of *October 1985*

[SEAL]

*Attest:*

DONALD J. QUIGG

*Attesting Officer*

*Commissioner of Patents and Trademarks—Designate*